US007917078B2

(12) United States Patent
Tsusaka et al.

(10) Patent No.: US 7,917,078 B2
(45) Date of Patent: Mar. 29, 2011

(54) WASTE COLLECTION DEVICE AND IMAGE FORMING APPARATUS

(75) Inventors: Shusaku Tsusaka, Nagoya (JP); Yoshiyuki Okazaki, Nagoya (JP); Koichi Kubo, Iwakura (JP); Takeshi Yamanaka, Seto (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 39 days.

(21) Appl. No.: 12/393,492

(22) Filed: Feb. 26, 2009

(65) Prior Publication Data

US 2009/0220257 A1 Sep. 3, 2009

(30) Foreign Application Priority Data

Feb. 29, 2008 (JP) ..... 2008-051237
Feb. 29, 2008 (JP) ..... 2008-051243
Feb. 29, 2008 (JP) ..... 2008-051248

(51) Int. Cl.
*G03G 21/12* (2006.01)

(52) U.S. Cl. ..... 399/360; 399/120

(58) Field of Classification Search ..... 399/360, 399/358, 120, 101
See application file for complete search history.

(56) References Cited

U.S. PATENT DOCUMENTS 5,907,752 A * 5/1999 Kondoh ..... 399/120
6,009,289 A 12/1999 Sekine et al.
7,107,002 B2 9/2006 Saito et al.
7,623,820 B2 11/2009 Nada et al.
2007/0110458 A1 5/2007 Inoue et al.
2007/0147859 A1 6/2007 Adachi et al.
2007/0196147 A1 8/2007 Nada et al.
2007/0230991 A1* 10/2007 Sato ..... 399/101
2009/0092429 A1* 4/2009 Yokota ..... 399/360
2009/0142116 A1* 6/2009 Sato et al. ..... 399/360

FOREIGN PATENT DOCUMENTS

JP 02-273777 11/1990
JP 03-125059 5/1991
JP 05-173457 7/1993
JP 09-194013 7/1997
JP 10-143050 5/1998
JP 11-015344 1/1999
JP 2000-132067 5/2000
JP 2001-296779 10/2001
JP 2001-324905 11/2001

(Continued)

OTHER PUBLICATIONS

Machine translation of JP 2002-148884 A dated Jun. 29, 2010.*

(Continued)

*Primary Examiner* — Sophia S Chen
(74) *Attorney, Agent, or Firm* — Banner & Witcoff, Ltd.

(57) ABSTRACT

A waste collecting device includes a first box including a top surface having a first opening, a bottom surface opposed to the top surface, and side surfaces connecting the top surface and the bottom surface and having a second opening, wherein the top surface, the bottom surface, and the side surfaces define a space allowing waste to be accommodated therein; a second box including a top surface, a bottom surface opposed to the top surface, and side surfaces connecting the top surface and the bottom surface and having a third opening, the third opening being in communication with the second opening; and a sending unit disposed in the first box and configured to send the waste in a direction away from the second box.

15 Claims, 13 Drawing Sheets

FOREIGN PATENT DOCUMENTS

| | | |
|---|---|---|
| JP | 2002-148884 | 5/2002 |
| JP | 2002-268399 | 9/2002 |
| JP | 2003-015504 | 1/2003 |
| JP | 2004-077607 | 3/2004 |
| JP | 2004-252491 | 9/2004 |
| JP | 2005-024661 | 1/2005 |
| JP | 2005-284031 | 10/2005 |
| JP | 2007-139905 | 6/2007 |
| JP | 2007-156253 | 6/2007 |
| JP | 2007-178947 | 7/2007 |
| JP | 2007-192855 | 8/2007 |
| JP | 2007-212974 | 8/2007 |
| JP | 2007-225742 | 9/2007 |

OTHER PUBLICATIONS

Machine translation of JP 2004-252491 A dated Jun. 29, 2010.*
Notice of Reasons for Refusal for Japanese patent application No. 2008-051237 dated Feb. 16, 2010.
Notice of Reasons for Refusal for Japanese patent application No. 2008-051243 dated Feb. 16, 2010.
Notification of Reasons for Refusal for corresponding Japanese Patent Application No. 2008-051243 mailed on Oct. 19, 2010.
Notification of Reasons for Refusal for corresponding Japanese Patent Application No. 2008-051248 mailed on Oct. 19, 2010.
Decision of Refusal for corresponding Japanese Patent Application No. 2008-051237 mailed on Oct. 19, 2010.

* cited by examiner

WASTE COLLECTION DEVICE AND IMAGE FORMING APPARATUS

CROSS REFERENCE TO RELATED APPLICATION

This application claims priority from Japanese Patent Application No. 2008-051248 filed Feb. 29 2008, Application No. 2008-051243 filed Feb. 29 2008, and Application No. 2008-051237 filed Feb. 29 2008. The entire content of these priority applications is incorporated herein by reference.

TECHNICAL FIELD

The present disclosure relates to a waste collecting device and an image forming apparatus.

BACKGROUND

An image forming apparatus such as a laser printer includes a toner carrier (e.g. a conveying belt) for conveying sheets, performing intermediate transfer, or the like. This toner carrier can have untransferred toner remaining clinging thereto. This residual toner can give an undesired influence to subsequent image forming operation.

There is a known image forming apparatus that includes a waste collecting device for collecting the waste clinging to the toner carrier. Furthermore, there is an image forming apparatus that further includes a waste detecting unit. The waste detecting unit detects an amount of the waste collected in the waste collecting device reaching a predetermined amount. With this waste detecting unit, overflow of the waste out of the waste collecting device is prevented from occurring.

Specifically, the known waste collecting device has a collection opening and a displaceable member. The collection opening allows the collected waste to enter, while the displaceable member is disposed directly below the collection opening. This displaceable member is displaced according to an amount of the waste accumulated and, by detecting this displacement, it is determined that the waste amount in the waste collecting device has reached the predetermined amount.

Moreover, there is another known waste collecting device that has a collection opening and a waste detecting sensor. The collection opening allows the collected waste to enter, while the waste detecting sensor is disposed near the collection opening. In this art, the waste accumulated directly below the collection opening is detected by the waste detecting sensor and, based on the detection results, it is determined whether or not the waste collecting device is filled with the waste.

SUMMARY

However, in any one of these known toner collecting devices, a zone or area directly below the collection opening is rendered or utilized as the waste detection zone for the waste detecting means. With this configuration, regardless of the amount of the waste collected in the waste collecting device, the waste collected through the collection opening always enters this detection zone and, therefore, the waste tends to be accumulated specifically in this detection zone, which can result in determination error that the waste has reached the predetermined amount (in spite that the amount of the waste collected in the toner collecting device is less).

Furthermore, the entire frame of any one of the known waste collecting devices is formed by welding or the like two members made of same material to each other. That is, it is not taken into consideration that material characteristics (intensity, quality of the material, and the like) to be required for each member are different.

An aspect of the present invention is a waste collecting device including a first box including a top surface having a first opening, a bottom surface opposed to the top surface, and side surfaces connecting the top surface and the bottom surface and having a second opening, wherein the top surface, the bottom surface, and the side surfaces define a space allowing waste to be accommodated therein; a second box including a top surface, a bottom surface opposed to the top surface, and side surfaces connecting the top surface and the bottom surface and having a third opening, the third opening being in communication with the second opening; and a sending unit disposed in the first box and configured to send the waste in a direction away from the second box.

Another aspect of the present invention is a waste collecting device including a first frame configured to support a removing member. The removing member can remove waste on a toner carrier. The waste collecting device also includes a second frame disposed adjacent to the first frame. The waste collection device also includes a third frame having a box shape with an entire top face thereof opened. The third frame can receive the waste removed by the removing member. The first frame and the second frame covers the opening of the third frame.

DETAILED DESCRIPTION

An illustrative aspect in accordance with the present invention will be described with reference to FIGS. 1 through 12.

1. General Configuration of Printer

Figure 1:
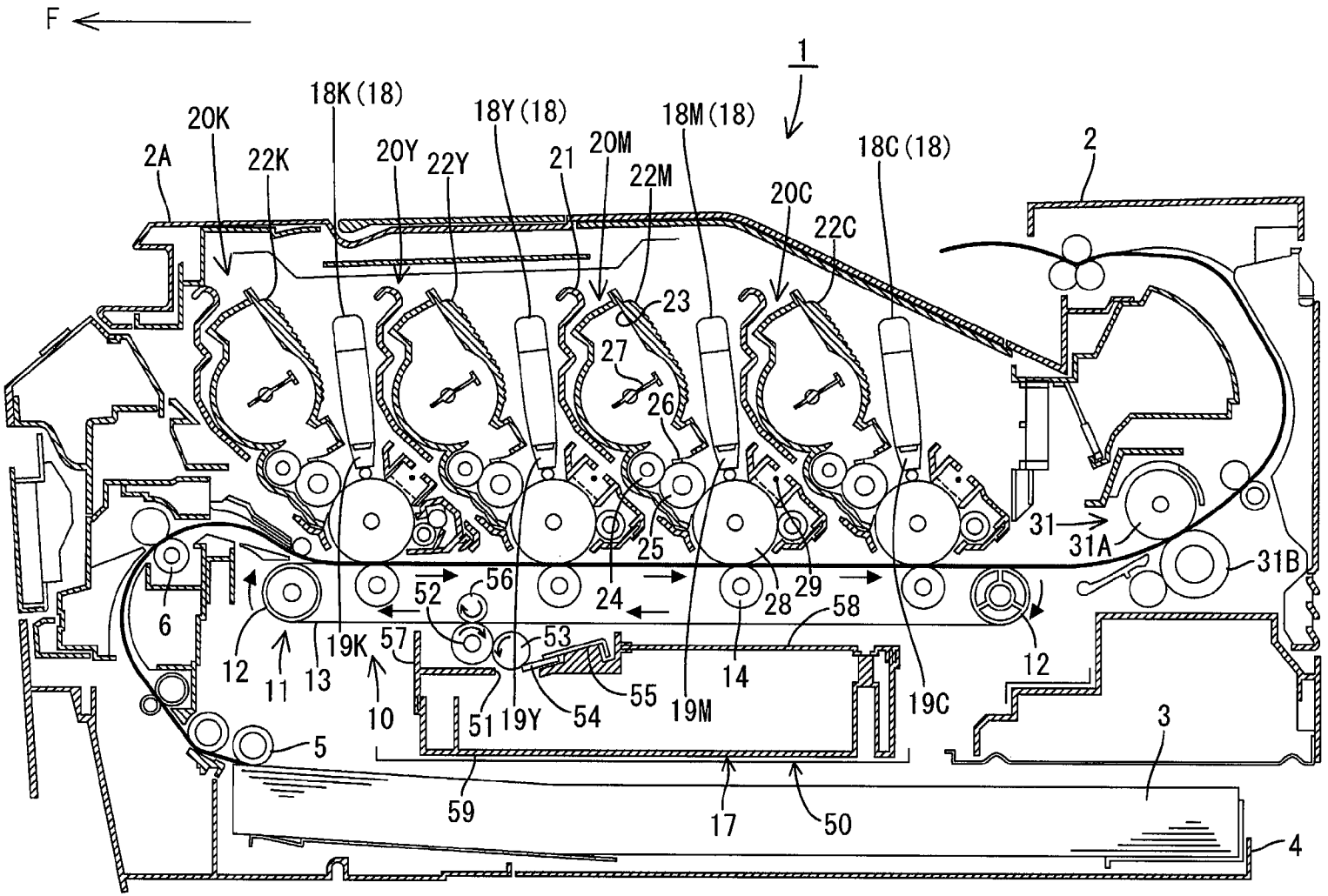
FIG. 1 is a side cross-sectional view showing a schematic configuration of a printer of an illustrative aspect in accordance with the present invention.

FIG. 1 is a side cross-sectional view showing a configuration of a printer 1 (an illustration of an image forming apparatus) of this illustrative aspect. Note hereinafter that the left direction in FIG. 1 represents the front direction of the printer 1. The front direction of the printer 1 is indicated as "F-direction" in each figure. The printer 1 is a color printer that can form color images using various colors of toner (for example, black (K), yellow (Y), magenta (M), and cyan (C), can be used). In a case of hereinafter distinguishing each component by color, "K", "Y", "M", or "C" that indicates the color will be added to the end of the reference numeral of the component.

The printer 1 includes a body casing 2. An openable cover 2A is provided on the top face of the body casing 2, while a sheet-feed tray 4 is provided in the bottom portion of the body casing 2. Sheets 3 (each an illustration of a recording media, which can be paper, plastic, and the like) can be stacked in the sheet-feed tray 4. A sheet-feed roller 5 is provided above the front end of the sheet-feed tray 4. As this sheet-feed roller 5 rotates, the uppermost one of the stacked sheets 3 is sent out to a registration roller 6. The registration roller 6 corrects skew travel of the sheet 3 and, thereafter, conveys the sheet 3 onto a belt unit 11 of an image forming portion 10.

The image forming portion 10 includes the belt unit 11, an exposing portion 18, a process portion, a fixing portion 31, and the like.

The belt unit 11 is configured by extending a looped belt 13 (an illustration of a toner carrier) between a front and a rear belt-support rollers 12. The belt 13 is made of polycarbonate or the like. By rotationally driving the rear belt-support roller 12, the belt 13 circulates in a clockwise direction in the figure, so that the sheet 3 on the belt 13 is backwardly conveyed. On the other hand, inside the loop of the belt 13, a transfer roller 14 is provided in each position opposed to each photosensitive drum 28 of the process portion (described below) across the belt 13.

a cleaning device 17 is provided under the belt unit 11. The cleaning device 17 collects toner, sheet powder, discharge products, and the like that are clinging to an outer surface of the belt 13 (hereinafter referred to as "waste W"). The cleaning device 17 (an illustration of a waste collecting device) will be described below.

The exposing portion 18 includes LED units 18K, 18Y, 18M, and 18C (each an illustration of an exposing unit). The LED units 18K, 18Y, 18M, and 18C correspond to colors of black, yellow, magenta, and cyan, respectively. LED units 18K, 18Y, 18M, and 18C are supported on a bottom face of the cover 2A by respective support members (not illustrated). LED units 18K, 18Y, 18M, and 18C have LED heads 19K, 19Y, 19M, and 19C, respectively, on bottom-end portions thereof. Each of the LED heads 19K, 19Y, 19M, and 19C is a plurality of light-emitting elements including LEDs arranged in line in the right-left direction. Light emission of the light-emitting elements is controlled based on an image data to be formed. Surfaces of the photosensitive drums 28 are irradiated with respective lights emitted from the light-emitting elements, and thus the surfaces are exposed.

A process portion 20 includes process cartridges 20K, 20Y, 20M, and 20C. Each of the process cartridges 20K, 20Y, 20M, and 20C corresponds to respective one of the above-described colors. The process cartridges 20K, 20Y, 20M, and 20C have respective cartridge frames 21 and developer cartridges 22K, 22Y, 22M, and 22C, respectively. Each of the developer cartridges 22K, 22Y, 22M, and 22C is detachably attached to respective one of the cartridge frames 21. Upon open of the cover 2A, the LED units 18K, 18Y, 18M, and 18C move out following the cover 2A, and the process cartridges 20K, 20Y, 20M and 20C become detachable from, or attachable to, the body casing 2. Note that, in this illustrative aspect, the above-described LED units 18K, 18Y, 18M, and 18C, the process cartridges 20K, 20Y, 20M, and 20C, and transfer rollers 14 configure separate image forming units.

Each of the developer cartridges 22K, 22Y, 22M, and 22C includes a toner storage 23 and, further, below the toner storage 23, a supply roller 24, a developer roller 25, a layer-thickness regulating blade 26, an agitator 27, and the like. Each toner storage 23 stores toner, which is a developer of each color. The toner released from the toner storage 23 is supplied onto the developer roller 25 by rotation of the supply roller 24, and is frictionally and positively charged between the supply roller 24 and the developer roller 25. Then, as the developer roller 25 rotates, the toner supplied onto the developer roller 25 enters between the layer-thickness regulating blade 26 and the developer roller 25, is further sufficiently frictionally charged there, and is carried on the developer roller 25 as a thin layer having an even thickness.

The photosensitive drums 28 (each an illustration of a photoreceptor) and chargers 29 (which can be of the scorotron type) are provided below the respective cartridge frames 21. The surface of each photosensitive drum 28 is covered with a photosensitive layer having a positive charge property. At the time of an image forming process, the photosensitive drum 28 is rotationally driven and, along with this, the surface of the photosensitive drum 28 is uniformly and positively charged by the charger 29. Then, the positively charged portion is exposed by high-speed light scanning. Thus, an electrostatic latent image, which corresponds to an image to be formed on the sheet 3, is formed on the surface of each photosensitive drum 28.

Next, by rotation of the developer roller 25, the positively charged toner is carried on the developer roller 25, faces the photosensitive drum 28, contacts therewith, and is supplied to the electrostatic latent image formed on the surface of the photosensitive drum 28. Thus, the electrostatic latent image on the photosensitive drum 28 is visualized, and a toner image supplied with toner only on the exposed portion thereof is carried on the surface of the photosensitive drum 28.

Thereafter, as the sheet 3 conveyed by the belt 13 passes the transfer positions between the photosensitive drums 28 and the transfer rollers 14, the toner images carried on the surfaces of the respective photosensitive drums 28 are transferred by negative transfer voltage onto the sheet 3 one by one. The sheet 3 that carries the transferred toner images is next conveyed to the fixing portion 31.

The fixing portion includes a heat roller 31A and a pressure roller 31B. The heat roller 31A has a heat source, while the pressure roller 31B presses the sheet 3 toward the heat roller 31A. The fixing portion 31 fuses the toner image transferred onto the sheet 3. The sheet 3 (fused by the fixing portion 31) is upwardly conveyed and exits onto the top face of the cover 2A.

2. Electrical Structure

Figure 2:
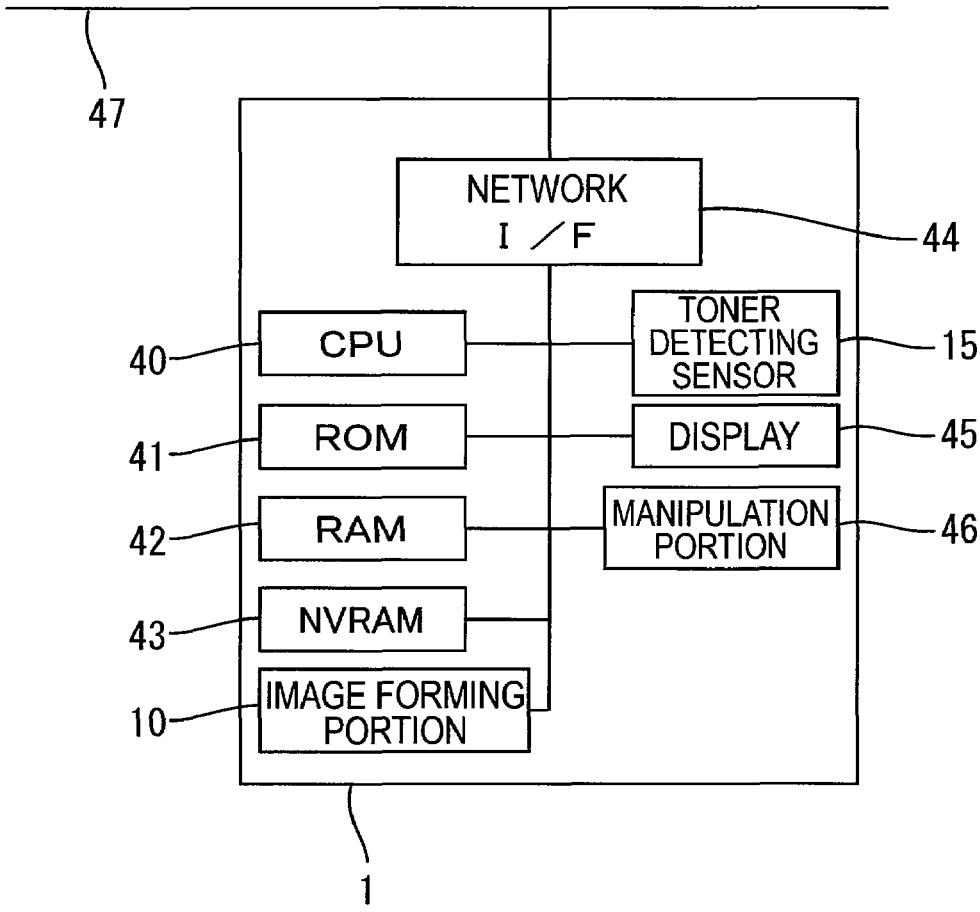
FIG. 2 is a block diagram showing an electrical structure of the printer.

FIG. 2 is a block diagram showing an electrical structure of the printer 1.

The printer 1 is, as shown in the same figure, includes a CPU 40 (an illustration of a determination unit), a ROM 41, a RAM 42, an NVRAM (nonvolatile memory) 43, and a network interface 44. They are connected to the image forming portion 10, a below-described waste detecting sensor 15 (an illustration of a waste detecting unit), a display 45, a manipulation portion 46, and the like.

The ROM 41 stores programs for executing each kind of operation of the printer 1 such as printing process and waste removing process. The CPU 40 reads out the programs from the ROM 41 and, according to the programs, performs controls of each portion, while storing results of the process in the RAM 42 or in the NVRAM 43. The network interface 44 can be connected to an external computer and the like (not illustrated) via communication lines 47, and thus mutual data correspondence can be performed.

3. Configuration of Cleaning Device

Figure 3:
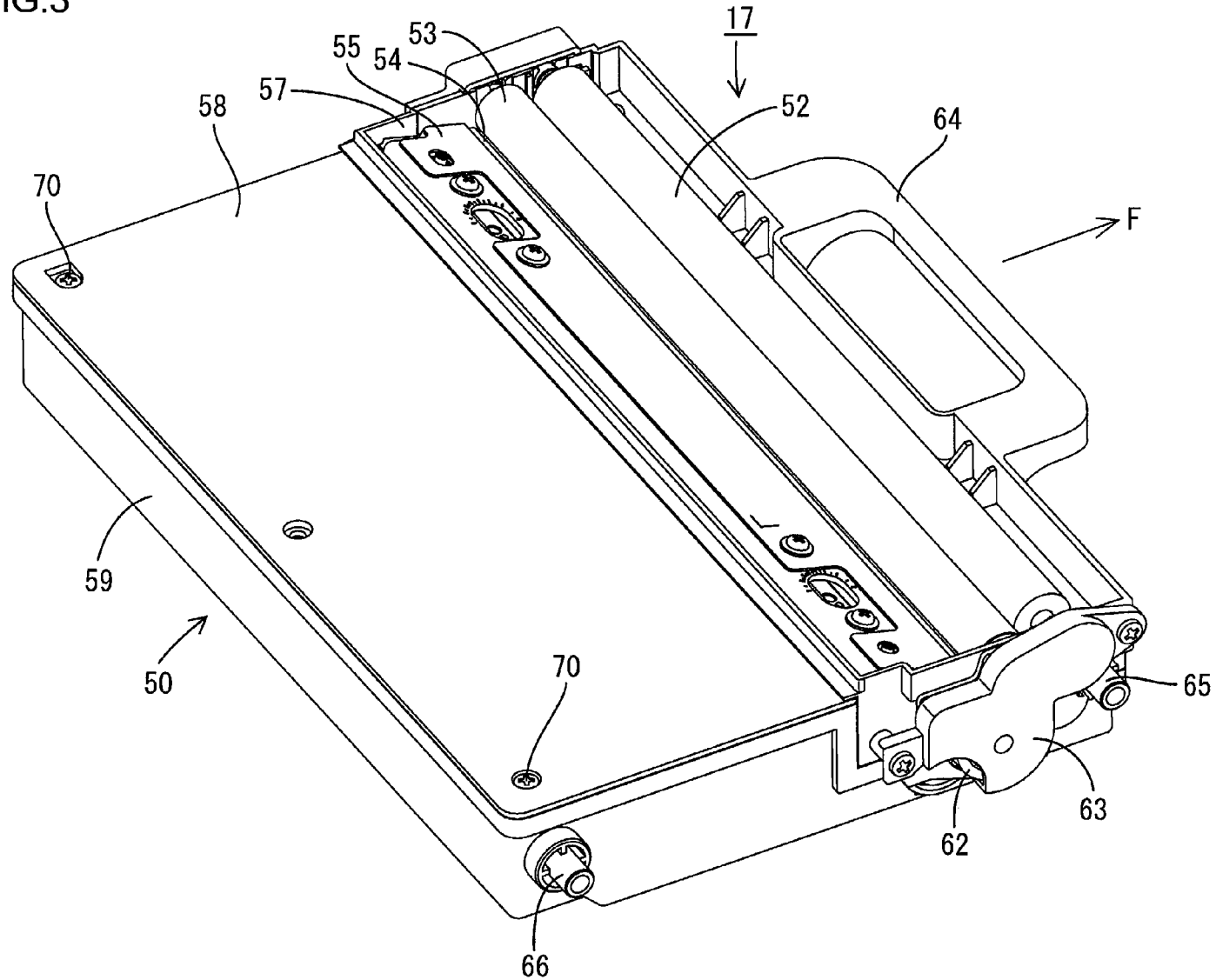
FIG. 3 is a perspective view of a cleaning device as viewed from above.
Figure 4:
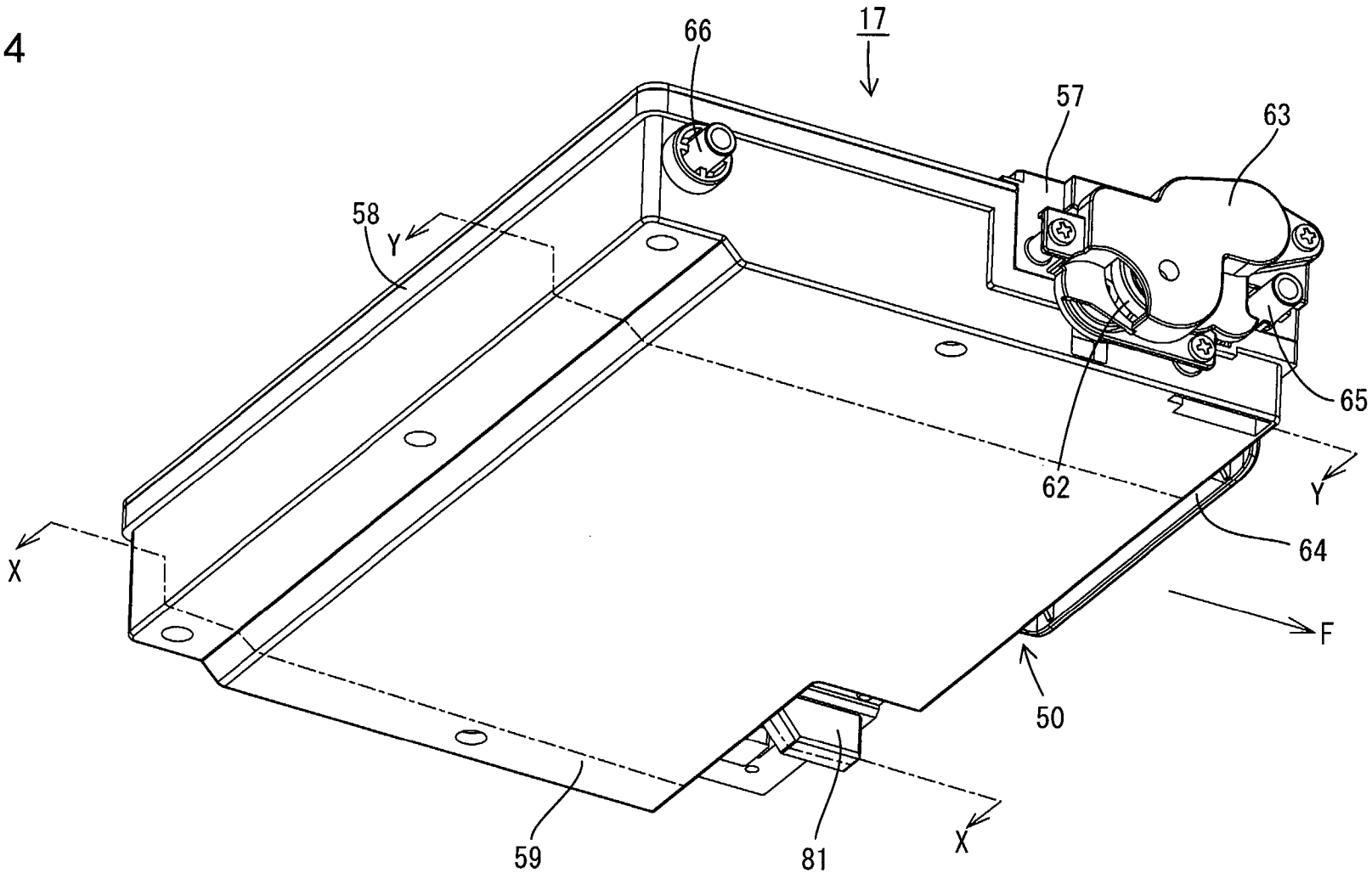
FIG. 4 is a perspective view of the cleaning device as viewed from below.
Figure 5:
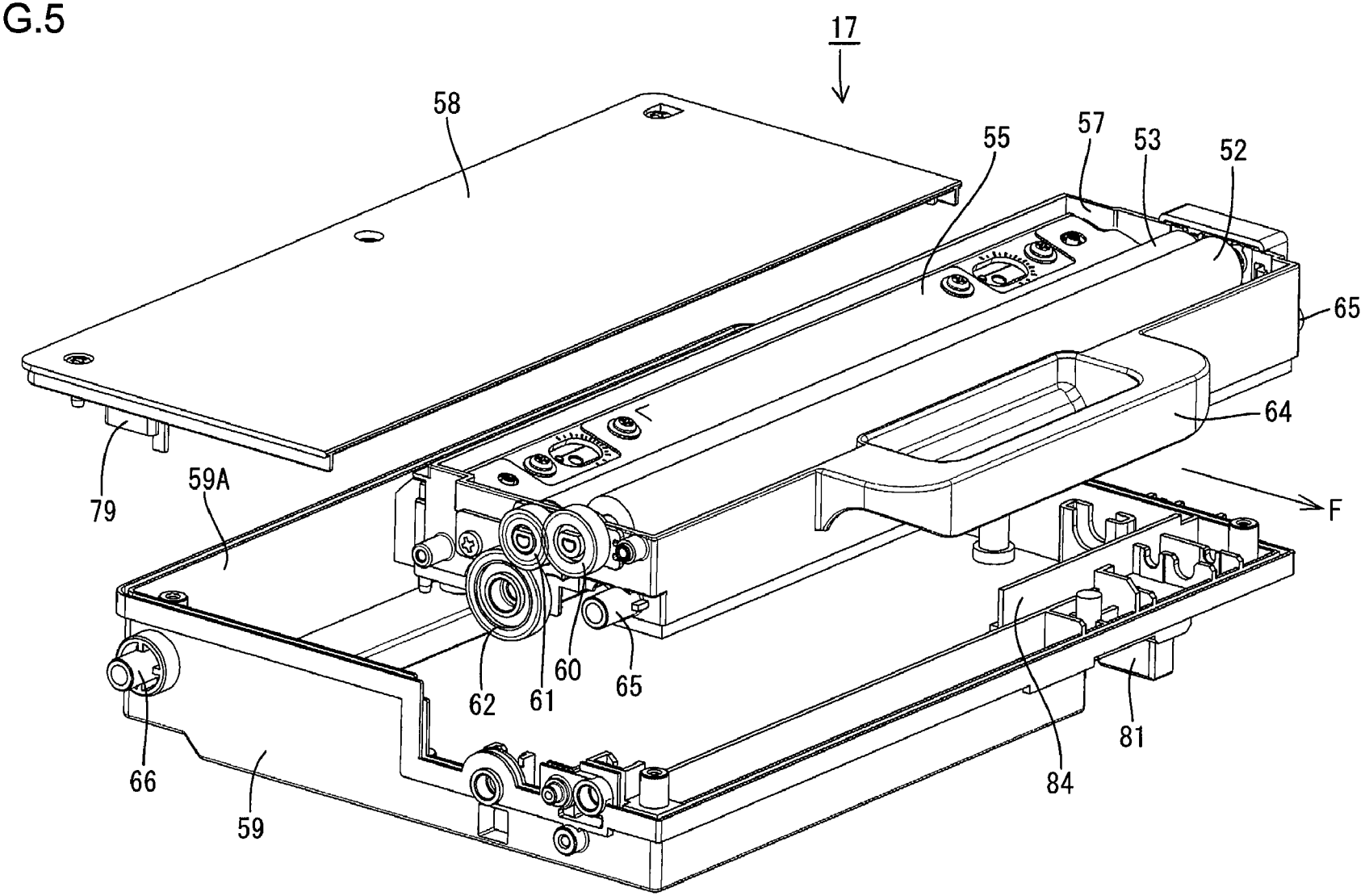
FIG. 5 is an exploded view of a parts of the cleaning device.

FIG. 3 is a perspective view of the cleaning device 17 as viewed from above. FIG. 4 is a perspective view of the cleaning device 17 as viewed from below. FIG. 5 is an exploded view of case 50 parts of the cleaning device 17. Note that the internal structure of the cleaning device 17 is omitted in FIG. 1 and FIG. 5, while the outer shape of the cleaning device 17 is simplified in FIG. 1.

As shown in FIG. 1, the cleaning device 17 includes the flat box-shaped case 50. The case 50 is provided below the belt 13. A collection opening 51 (an illustration of an first opening) is defined in the top face and in the front-end side of the case 50. A cleaning roller 52 (an illustration of a removing member) is rotatably provided near this collection opening 51. The cleaning roller 52 is, for example, a foamed silicon roller that is configured by coating a metal roller shaft with a roller body made of conductive foamed material. Note that a backup roller 56 is rotatably provided above the cleaning roller 52. The backup roller 56 is made of conductive material such as metal. The backup roller and the cleaning roller 52 hold the belt 13 therebetween from above and beneath.

A scraping roller 53 is rotatably provided behind the cleaning roller 52 in a manner pressed onto the cleaning roller 52. This scraping roller 53 is a metal roller made of hard material such as metal and the like.

Furthermore, a rubber blade 54 as a scraping member is provided under the scraping roller 53 in a cantilever manner. The rear-end portion of the blade 54 is adhered to a holder 55, while the front-end portion, which is a free end, is pressed onto a bottom face of the scraping roller 53 by elastic force of a body of the blade 54.

Waste removing process is executed, for example, after printing process. The waste removing process is executed as follows. While the belt 13 circulates in the clockwise direction in the figure, a driving force from a motor (not illustrated) rotationally drives the cleaning roller 52 in a direction opposing against the circulating direction of the belt 13, i.e. in a clockwise direction, proximate the contacting face. At the same time with this, the scraping roller 53 is rotationally driven in the counter-clockwise direction in the figure. On the other hand, the backup roller 56 circulates in the clockwise direction in the figure along with the circulation of the belt 13.

The roller shaft of the backup roller 56 is grounded. At a time of the waste removing process, negative bias is applied to the cleaning roller 52, while a lower negative bias is applied to the scraping roller 53. Thus, by bias attraction and by contact force of the cleaning roller 52, waste W clinging to the belt 13 moves to the cleaning roller 52 near the position where the cleaning roller 52 is opposed to the backup roller 56. Then, the waste W carried on the cleaning roller 52 moves to the hard scraping roller 53 by bias attraction. Thereafter, the waste W carried on the scraping roller 53 is removed by the scraping blade 54. Finally, the scraped waste W falls in the case 50 via the collection opening 51. Note that, of course, in order to remove negatively charged sheet powder, bias of the polarity opposite to the above-illustrated polarity will be applied to the cleaning roller 52 and the like.

(1) Case Structure of Cleaning Device

As shown in FIG. 5, the case 50 is configured by three members, i.e. a first frame 57, a second frame 58, and a third frame 59.

The first frame 57 supports the above-described cleaning roller 52, the scraping roller 53, and the blade 54. Specifically, the first frame 57 has a rectangular shape having a right-left width greater than a lateral width of the belt 31. The collection opening 51 is defined by opening a portion substantially central in the front-back direction of the first frame 57. This collection opening 51 has a rectangular shape extending in the right-left direction. A right-left width of the collection opening is equal to or greater than the right-left width of the belt 13. Furthermore, a handle 64 is provided on the front-end portion of the first frame 57.

Each of the cleaning roller 52, the scraping roller 53, and the blade 54 has a length equal to or greater than the right-left width of the belt 13. The scraping roller 53 is disposed above the collection opening 51. Note that, in practice, the cleaning roller 52 is designed so as to have the right-left width dimension greater than an estimated width of waste spilling from the developer cartridges 22, while the belt 13 is designed so as to have the right-left width greater than the right-left width of the cleaning roller 52. Gears 60, 61 are provided on respective end portions (for example, the left-end portions) of the cleaning rollers 52 and the scraping roller 53. These gears 60, 61 are meshed with each other. Furthermore, the gear 61 is meshed with an input gear 62. When the cleaning device 17 is attached in the body casing 2, this input gear 62 is meshed with an output gear (not illustrated) provided on the body casing 2. Then, the cleaning roller 52 and the scraping roller 53 are rotationally driven by rotationally driving the output gear. Note that the first frame 57 is provided with a gear cover 63. As shown in FIG. 3 and the like, the gear cover 63 covers the gears 60, 61, and partially the input gear 62, and thereby protects the gears 60, 61, and the input gear 62. Furthermore, bosses 65, 65 are formed in a protruding manner on the right and left ends of the first frame 57. The bosses 65, 65 can be fitted in respective support portions (not illustrated) provided on the body casing 2.

The second frame 58 is disposed behind the above first frame 57 and adjacent to the first frame 57. The second frame 58 has a rectangular flat plate shape extending in the right-left direction as a whole.

The third frame 59 serves as a receptacle of the waste W collected by the cleaning roller 52. The third frame 59 has a box shape with the entire top face thereof opened. The opened portion 59A is covered with the first frame 57 and the second frame 58. Furthermore, positioning bosses 66, 66 are formed in a protruding manner on rear-end portions of respective right and left faces of the third frame 59. The positioning bosses 66, 66 can be fitted in support portions (not illustrated) provided on the body casing 2. With the positioning bosses 66, 66, the cleaning device 17 is positioned with respect to the body casing 2. Note that the internal structure of each of the second frame 58 and the third frame 59 will be described below.

The first frame 57, the second frame 58, and the third frame 59 are secured to each other, for example, screwed in a state where the edge portions thereof are meshed with each other. For example, as shown in FIG. 1 and in below-described FIG. 8, concavities and convexities provided along the edge portions of the second frame 58 are meshed with the concavities and convexities provided along the edge portions of the first frame 57 and the third frame 59, and this second frame 58 is fastened to the third frame 59, for example, with screws 70, 70.

In this illustrative aspect, the first frame 57 is made of rigid material such as glass-fiber resin. This causes effects as follows. While the cleaning roller 52, the scraping roller 53, the blade 54, and the gears 60 to 62 have certain weights, the first frame 57 can steadily support these cleaning roller 52 and the like. Furthermore, the first frame 57 can steadily press the cleaning roller 52 and the scraping roller 53 onto each other and, further, can uniformly contact the scraping roller 53 with the blade 54 over the entire width of the belt 13. Therefore, higher collection performance for waste W can be obtained. Moreover, because the above-described positioning bosses 65, 65 are provided on the first frame 57 and near the rotational shafts of the cleaning roller 52 and the scraping roller 53, tolerance in the positional relationship between the body casing 2, the cleaning roller 52, and the scraping roller 53 can be reduced in comparison with a case where the first frame 57 is made of soft material such as polystyrene resin (PS resin).

On the other hand, the second frame 58 and the third frame 59 are made of soft material such as PS resin. Thus, by forming only the first frame 57, which specifically requires higher rigidity, out of glass-fiber resin that is comparatively more expensive, while forming the other frames (the second frame 58 and the third frame 59) out of PS resin that is comparatively cheaper, a total cost of the cleaning device can be reduced.

Furthermore, because the third frame 59 has a shape with the entire top face thereof opened, stripping process at a time of forming the third frame 59 is easier.

Suppose here that the first frame 57, the second frame 58, and the third frame 59 are assembled by welding. Then, attachment and position adjustment of the cleaning roller 52 and the like can be performed only after welding. To the contrary, in this illustrative aspect, the case 50 is configured by assembling the first frame 57, the second frame 58, and the third frame 59 by screwing, not by welding. Therefore, attachment and position adjustment of the cleaning roller 52 and the like to the first frame 57 can be performed before assembly. Furthermore, when taking away the waste W collected in the cleaning device 17, it is only necessary to disengage only the second frame 58. This makes it easier to take away the waste W.

In addition, The first frame 57, the second frame 58, and the third frame 59 are meshed with each other along the edge portions thereof. This serves in reducing spill of waste W from gaps between the first frame 57 and the second frame 58, between the second frame 58 and the third frame 59, and between the third frame 59 and the first frame 57.

Furthermore, in this illustrative aspect, by opening the cover 2A and detaching the process cartridges 20K, 20Y, 20M, and 20C and the belt unit 11, the cleaning device 17 can be detached from the body casing 2. Because the first frame 57 supports the cleaning roller 52 and the like, the first frame 57 can be heavier than the other frames 58, 59. Therefore, in this illustrative aspect, the first frame 57 is provided with the handle 64. By this, the center of gravity of the whole cleaning device 17 comes closer to the handle 64 and, therefore, the cleaning device is easy to carry.

Suppose that the handle 64 is provided in the side opposite to the collection opening 51 (the rear-end side of the cleaning device 17). Then, when grasping the handle 64 and lifting the cleaning device 17, the collection opening 51 comes to a lower-end side of the cleaning device 17, and the collected waste W can spill from the collection opening 51. To the contrary, in this illustrative aspect, the handle 64 is provided on the collection opening 51 side. Therefore, when grasping the handle 64 and lifting the cleaning device 17, the collection opening 51 is positioned at the upper-end side of the cleaning device 17, and spill of the waste W from the collection opening 51 can be reduced.

(2) Internal Structure of Cleaning Device

Figure 6:
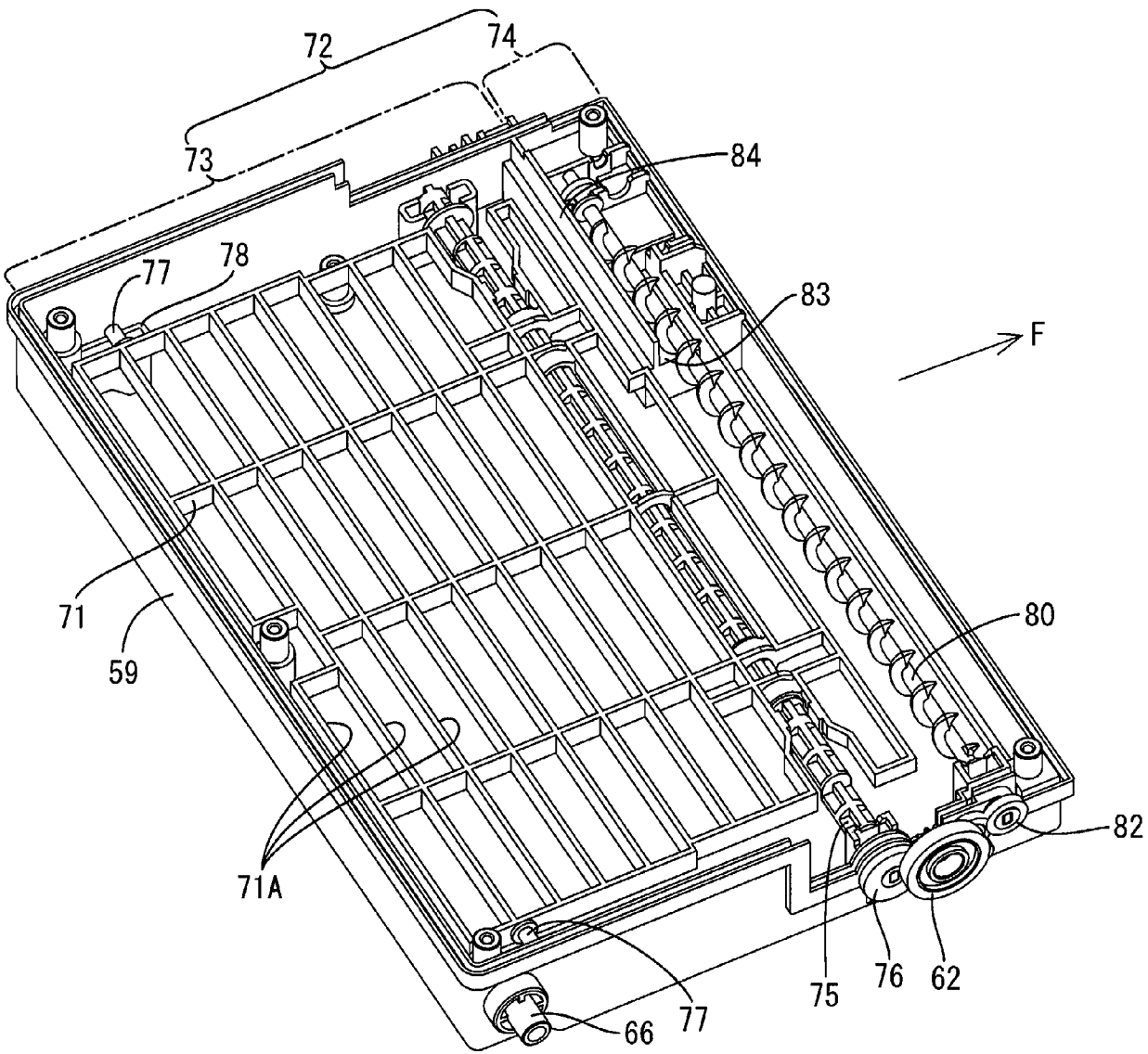
FIG. 6 is a perspective view showing an internal structure of a third frame.
Figure 7:
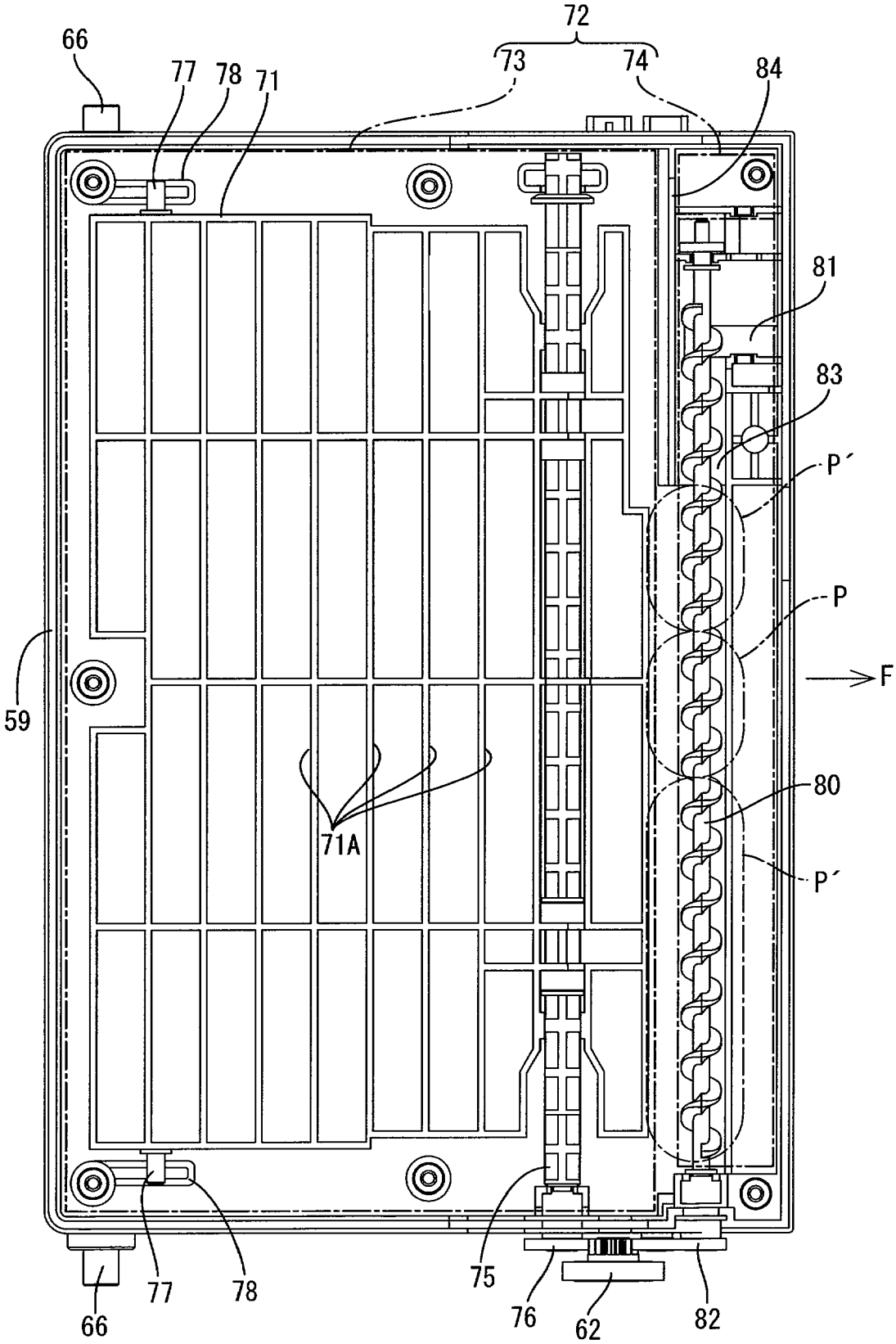
FIG. 7 is a top view showing the internal structure of the third frame.

FIG. 6 is a perspective view showing an internal structure of the third frame, while FIG. 7 is a top view showing the internal structure of the third frame. Each of FIGS. 8 through 11 is a cross-sectional view of the cleaning device 17 indicating a path of rotational movement of a below-described sending member 71. In each of FIGS. 8 through 11, an outline arrow indicates the direction in which waste W is sent by the sending member 71, while black bold arrows indicate a rotational direction of a crankshaft 75 of the sending member 71 and a movement direction of protrusions 77, respectively.

The third frame 59 includes a waste-accommodating portion 72 for accommodating the waste W that has been collected by the cleaning roller 52 and has entered the collection opening 51. This waste-accommodating portion 72 includes a first waste-accommodating portion 73 and a second waste-accommodating portion 74. Note that, in the case 50, a part corresponding to the first waste-accommodating portion 73 is a first box, while a part corresponding to the second waste-accommodating portion 74 is a second box.

Figure 8:
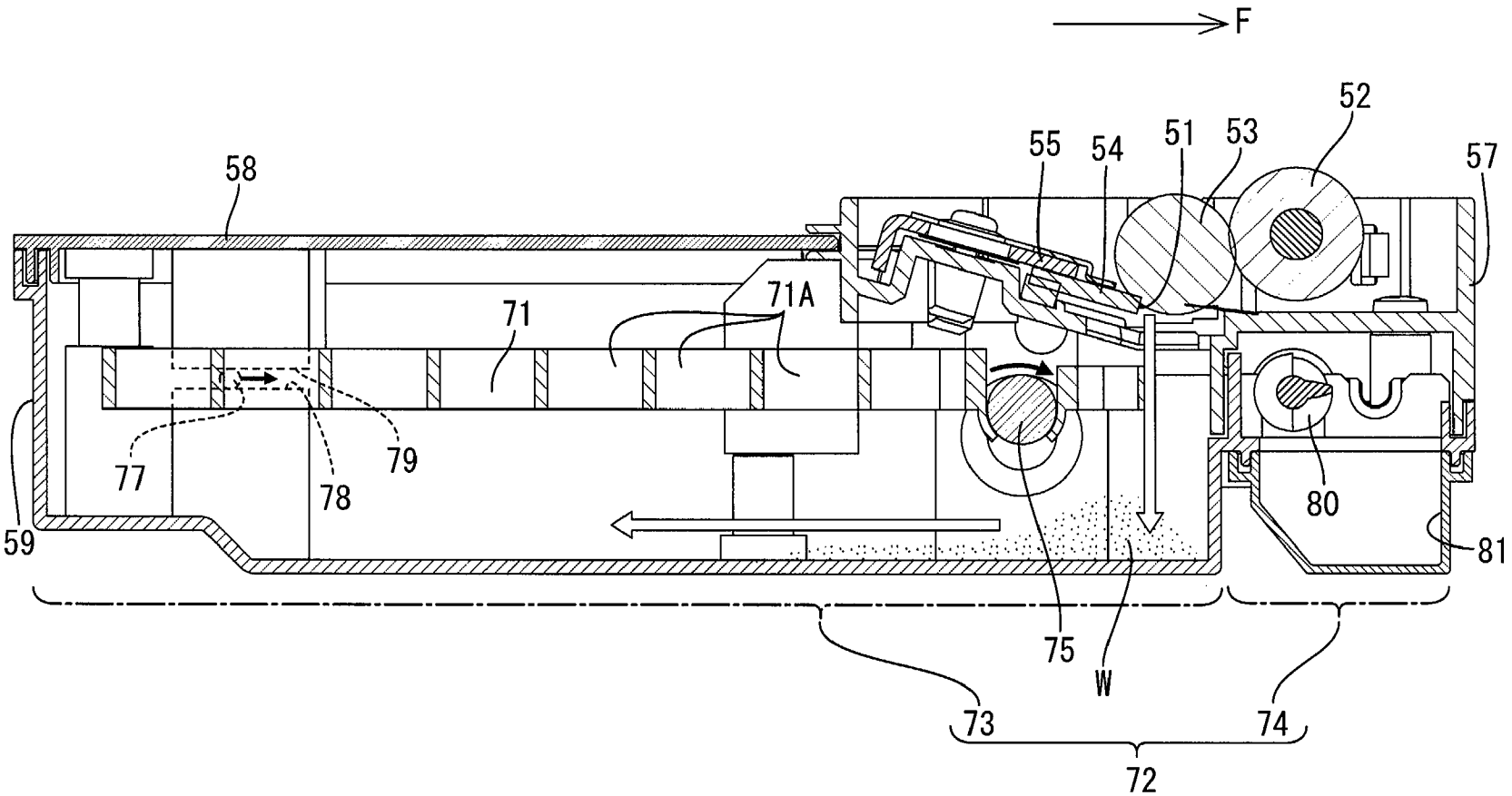
FIG. 8 is a first cross-sectional view of the cleaning device taken along line X-X of FIG. 4.
Figure 9:
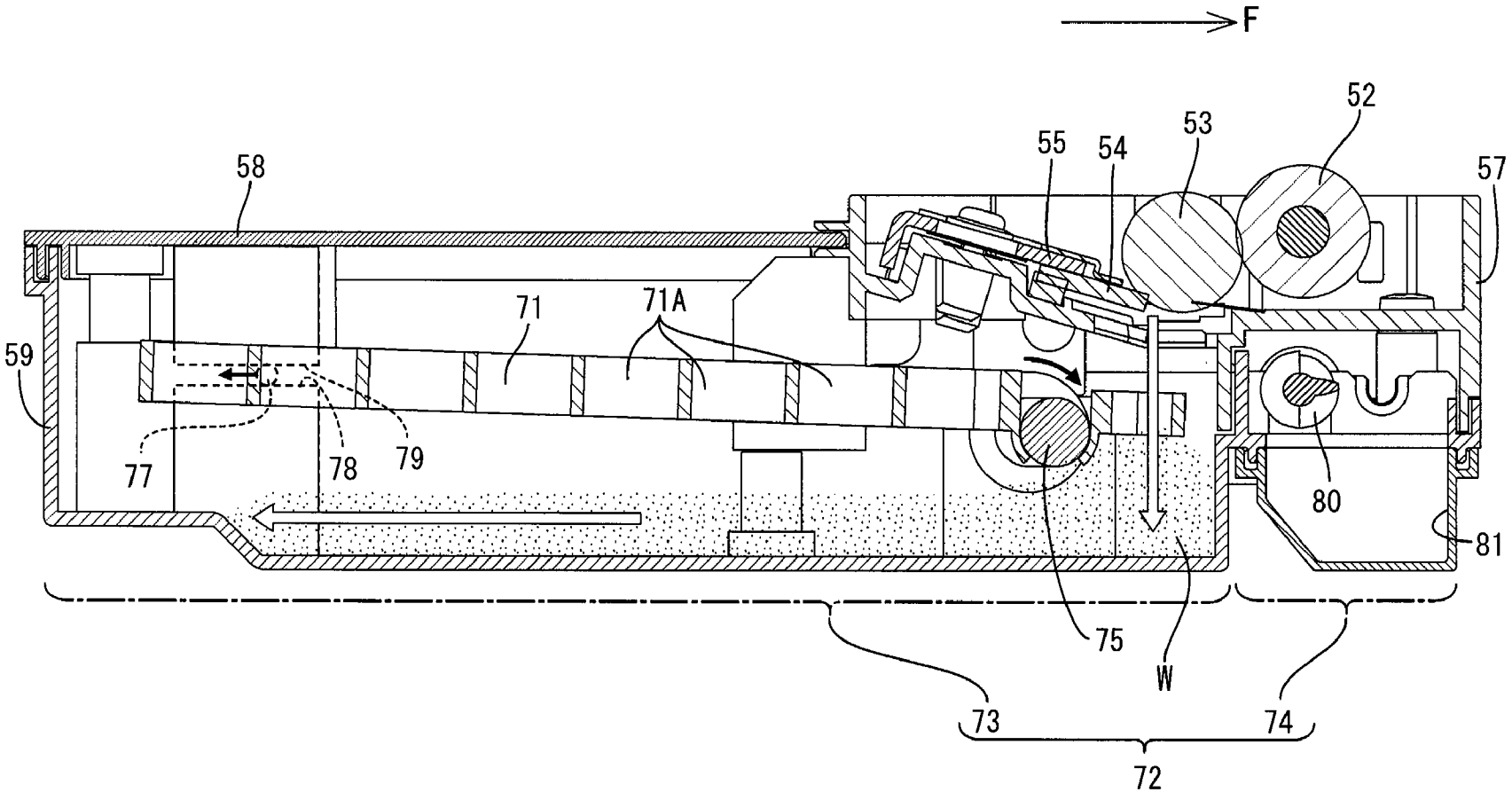
FIG. 9 is a second cross-sectional view of the cleaning device taken along the line X-X of FIG. 4.
Figure 10:
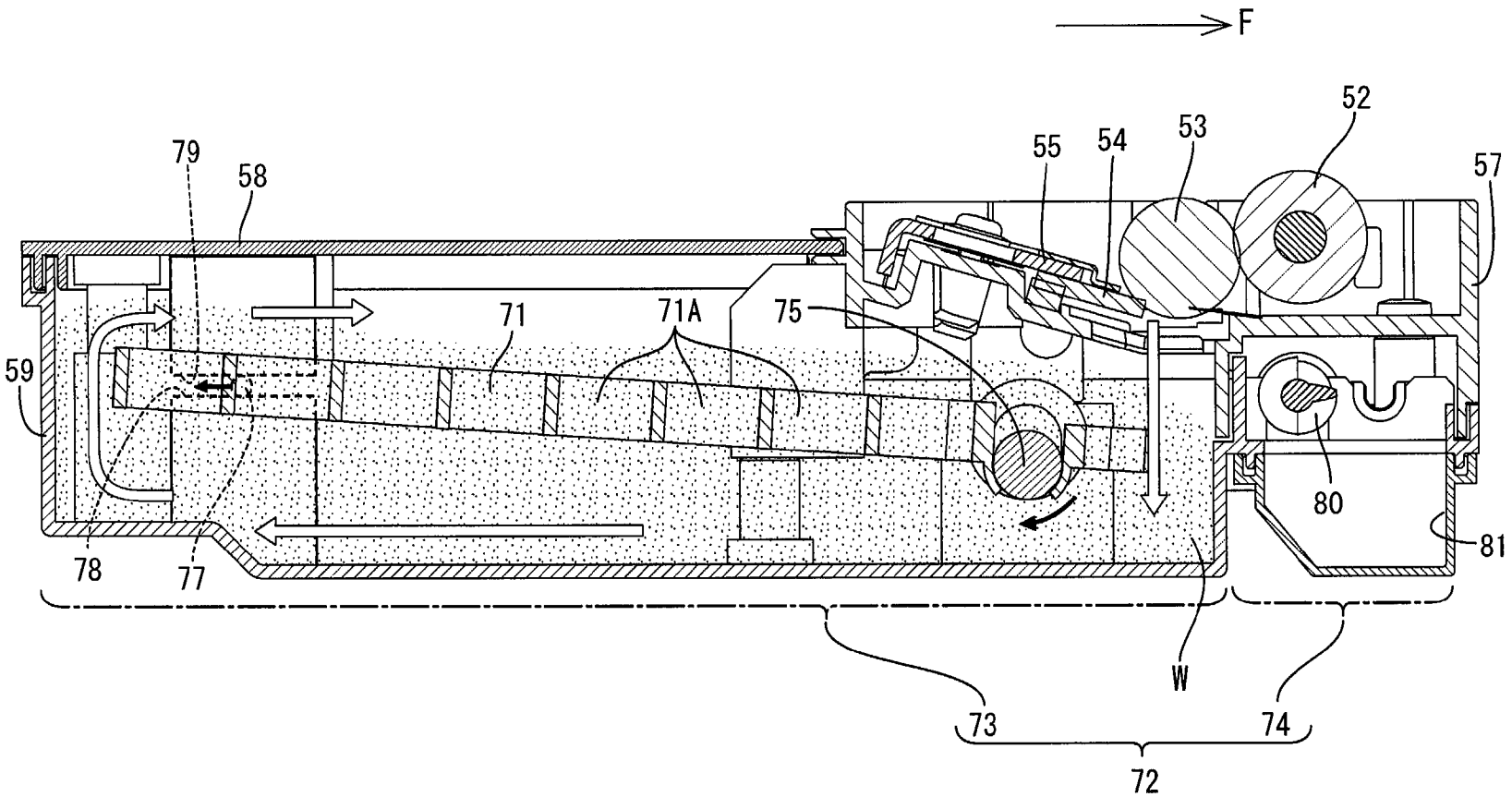
FIG. 10 is a third cross-sectional view of the cleaning device taken along the line X-X of FIG. 4.
Figure 11:
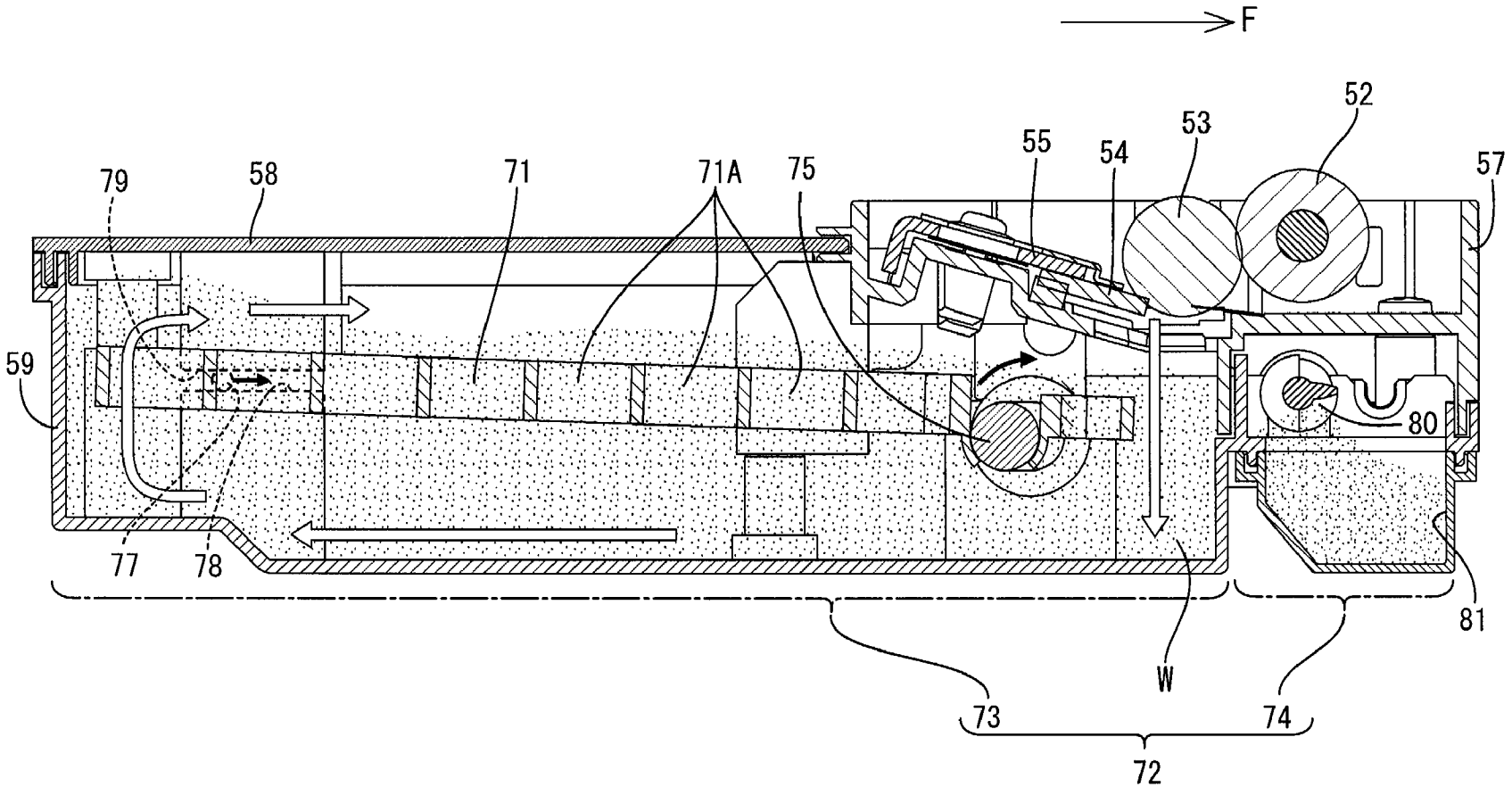
FIG. 11 is a fourth cross-sectional view of the cleaning device taken along the line X-X of FIG. 4.
Figure 12:
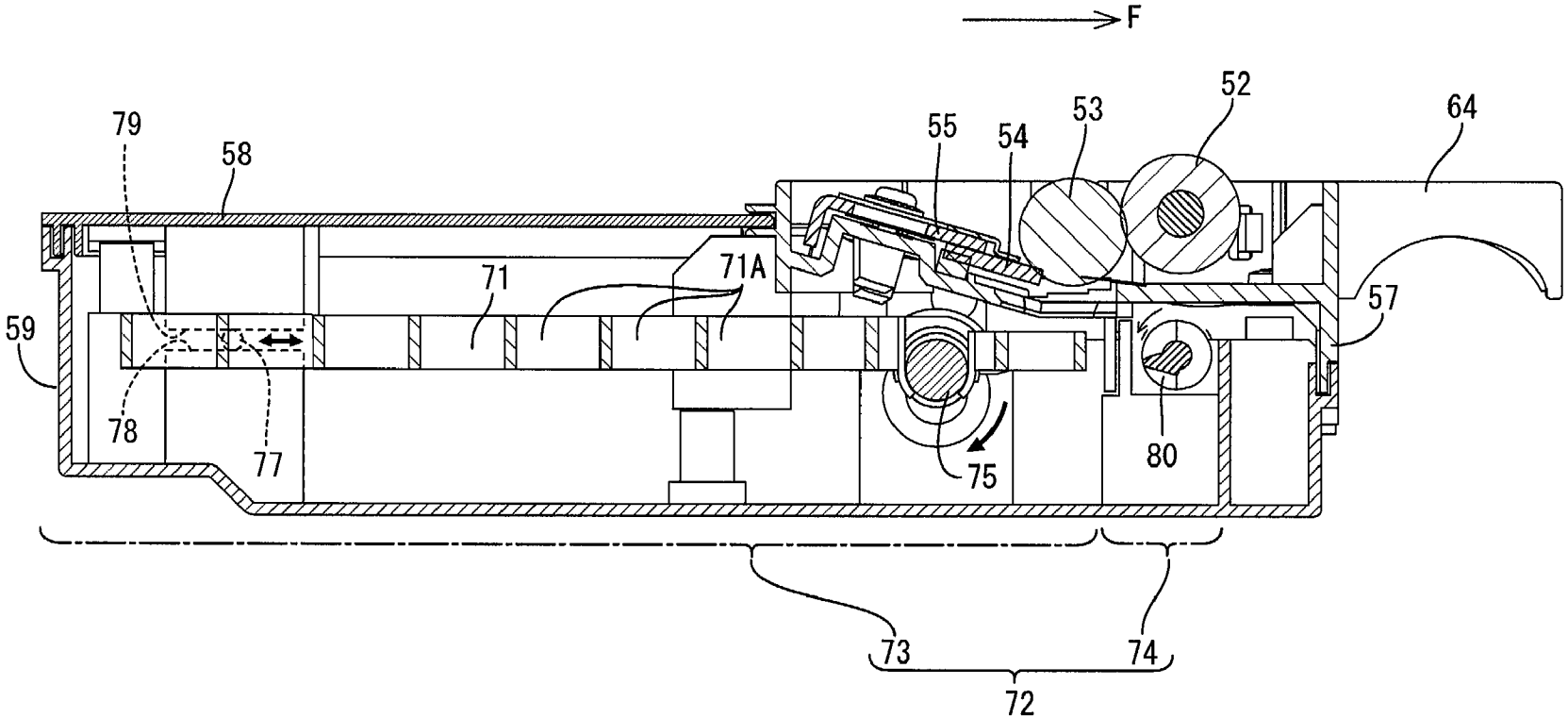
FIG. 12 is a cross-sectional view of the cleaning device taken along line Y-Y of FIG. 4.

The first waste-accommodating portion 73 is located directly below the above-described collection opening 51 and directly receives the waste W that has entered from the collection opening 51. Specifically, as shown in FIGS. 7, 8, and the like, the first waste-accommodating portion 73 is a space expanding from a zone or area directly below the collection opening 51 to a rear wall of the third frame 59. In addition, the first waste-accommodating portion 73 is upwardly stepped toward the rear wall. That is, a bottom face of the rear-end portion is higher by a step than the other portions thereof.

The first waste-accommodating portion 73 is provided with a sending unit. The sending unit sends the waste W, which has entered from the collection opening 51, in a direction opposite to the second waste-accommodating portion 74 (the rear wall of the third frame 59). Specifically, this sending unit has the sending member 71. The crankshaft 75 rotates a front-end portion of this sending member 71 in the collection opening 51 side, so that a rear-end portion of the sending member 71 reciprocates back and forth (see the black bold arrows in each of FIGS. 8 through 11). As shown in FIGS. 6 and 7, the sending member 71 has a rectangular flat plate shape as a whole and a plurality of holes 71A defined therethrough; the sending member 71 thus has a lattice-like structure.

The crankshaft 75 has a rotational axis substantially in parallel to the cleaning roller 52 and the like. The front-end portion of the sending member 71 can be rotated by the crankshaft 75. A gear 76 is provided on the left-end portion of the crankshaft 75. This gear 76 is meshed with the above-described input gear 62. Two protrusions 77, 77 are provided on the rear-end portion of the sending member 71. The protrusions 77, 77 are movable back and forth while being restricted in up-and-down movement by a guide portion 78 of the third frame 59 and a guide portion 79 of the second frame 58 (see FIG. 5).

When the input gear 62 is rotationally driven, the crankshaft 75 rotates in a clockwise direction in FIG. 8. Then, the front-end portion of the sending member 71 moves around the crankshaft 75 and, following this, the protrusions 77 are guided by the guide portions 78, 79 so that the rear-end portion of the sending member 71 moves back and forth. Note that, in this illustrative aspect, the rear-end portion of the sending member 71 moves back and forth on a level higher than the level of the rotational center of the crankshaft 75.

The waste W, which has fallen from the collection opening 51, is accumulated directly below the collection opening 51 into heaps (see FIG. 8). Then, when the upper portions of the heaped waste W contacts the sending member 71, the waste W of the upper portions is moved backward by the sending member 71 (see FIG. 9). Thereafter, when the amount of the waste W accumulated in the first waste-accommodating portion 73 accumulates more and a large amount of waste W is accumulated in the rear-end side of the first waste-accommodating portion 73, then, the waste W comes to contact with the rear-end portion of the sending member 71 and begins to be sent toward the center of the first waste-accommodating portion 73 (see FIGS. 10 and 11). Thus, the waste W can be uniformly accommodated in the entire first waste-accommodating portion 73.

Note that, when the sending member 71 is located at the uppermost position (see FIG. 10), there is a clearance between the second frame 58 that serves as a ceiling of the case 50. This is in order to allow the sending member 71 to smoothly move even when the first waste-accommodating portion 73 is filled with the waste W and, at the same time, to prevent spill of waste W out of the case 50.

On the other hand, after the amount of the waste W accommodated in the first waste-accommodating portion 73 reaches a predetermined amount, the second waste-accommodating portion 74 receives the waste W spilled from the first waste-accommodating portion 73. Specifically, the second waste-accommodating portion 74 is located in front of the zone directly below the collection opening 51, and is in communication with the first waste-accommodating portion 73 (see FIGS. 6 and 12) This communication opening is a second opening and a third opening. The second waste-accommodating portion 74 includes an auger 80 and a detection portion 81. The auger 80 and the detection portion 81 are disposed in the second waste-accommodating portion 74. The waste W moved by the auger 80 is accommodated in the detection portion 81.

The auger 80 has a rotational shaft and a spiral blade formed around the outer periphery of the rotational shaft. The rotational shaft has a rotational axis substantially in parallel to the cleaning roller 52 and the like. A gear 82 is provided on the left-end portion of the auger 80. The gear 82 has a gear connection with the above-described input gear 62 via an idle gear. When the input gear 62 is rotationally driven, the auger 80 rotates and sends the waste W accumulated in the second waste-accommodating portion 74 toward the right (upwardly in FIG. 7).

As shown in FIG. 6, a raised bottom portion 83 is formed below the right-end side of the auger 80. The raised bottom portion 83 is raised by a step. The above-described detection portion 81 is opened to the raised bottom portion 83. Thus, only the waste W sent by the auger 80 and raised up onto the raised bottom portion 83 is accommodated in the detection portion 81 (see FIG. 11).

The detection portion 81 has a flat shape to the right and left. The detection portion 81 is made of light-transmissive material. The waste detecting sensor 15 is, for example, of a transmission type having a light-emitting portion and the light-receiving portion disposed in a manner opposed to each other across the detection portion 81. When the amount of the waste W accommodated in the detection portion 81 becomes equal to or more than a predetermined amount, the waste detecting sensor 15 of transmission type is in a light-blocked state. The above-described CPU 40 determines based on a detection signal from the waste detecting sensor 15 whether or not the amount of the waste W accommodated in the detection portion 81 has reached the predetermined amount, i.e. a full or near-full state.

Provided between the first waste-accommodating portion 73 and the raised bottom portion 83 is a guard wall 84. This guard wall 84 prevents the waste W in the first waste-accommodating portion 73 from directly entering the detection portion 81.

With the above-described configuration, while the waste W that has entered the collection opening 51 is accommodated in the first waste-accommodating portion 73, the waste W accommodated in this first waste-accommodating portion 73 is not rendered to detection performed by the waste detecting sensor 15. On the other hand, the waste W that has entered from the first waste-accommodating portion 73 is accommodated in the second waste-accommodating portion 74, and this waste W accommodated in the second waste-accommodating portion 74 is rendered to the detection performed by the waste detecting sensor 15. Therefore, determination error that the amount of the accommodated waste W has reached the predetermined amount (in spite that the accommodated amount is less) can be reduced in comparison with a known waste collecting device having a detection zone directly below a collection opening 51.

Furthermore, until the waste W is accumulated to a certain amount in the first waste-accommodating portion 73, entrance of the waste W into the second waste-accommodating portion 74 can be reduced by the sending unit. Therefore, the determination error that the amount of the accommodated waste W has reached the predetermined amount (in spite that the accommodated amount is less) can be still more reliably reduced.

Furthermore, the waste W that has entered the collection opening 51 is accommodated in the waste-accommodating portion 72. The accommodated waste W is further sent to the detection portion 81 by rotation of the auger 80. The waste W accommodated in this detection portion 81 is rendered to the detection performed by the waste detecting sensor 15. Here, even if a large amount of waste W is accumulated into heaps in a particular zone near the auger 80 (a zone indicated by a reference numeral Pin FIG. 7), it is impossible for the waste W in this zone P to be directly rendered to the detection performed by the waste detecting sensor 15. The auger 80 rotates and thereby moves (and evens), the waste W in the zone P and in other zones P' along the rotational shaft direction. Then, the waste W finally moved into the detection portion 81 is rendered to the detection performed by the waste detecting sensor 15. That is, regardless of difference in zones where the large amount of waste W is accumulated, the auger 80 moves the waste W accumulated in these zones in the direction of the rotational shaft. Thus, when the waste W is accumulated in the second waste-accommodating portion 74 to a predetermined height and substantially over the entire length of the auger 80, the waste W begins to enter the detection portion 81 (see FIG. 11). Consequently, variety in detection results depending on the difference in the zones where the large amount of waste W is accumulated can be reduced.

Suppose here that the handle 64 and the detection portion 81 are disposed in opposite sides in the case 50. Then, when the handle 64 is grasped and the cleaning device 17 is inclined, the waste W in the first waste-accommodating portion 73 is caused to enter the detection portion 81. Then, when the cleaning device 17 is settled again in the body casing 2, determination error that the amount of the waste W accommodated in the cleaning device 17 has reached the predetermined amount (in spite that the accommodated amount is less) can be caused. To the contrary, in this illustrative aspect, the handle 64 and the detection portion 81 are provided in a same side in the case 50. Therefore, such a problem as described above is difficult to be caused.

<Other Illustrative Aspects>

The present invention is not limited to the illustrative aspect as described above with reference to the drawings; for example, the following illustrative aspects are also included within the scope of the present invention.

(1) In the above-described illustrative aspect, the belt 13 for conveying sheets is adopted as the "toner carrier". A main purpose of the belt 13 is to convey the sheets 3. Density patches or registration marks for color shift detection are printed on the belt 13 at proper timings and, thereafter, these patches or registration marks are collected by the cleaning device 17. The present invention is not limited to this; the belt may be an intermediate transfer belt or a photoreceptor belt with a main purpose is to carry toner images.

(2) In the above illustrative aspect, the second frame 58 is configured to be detachably attached by screws 70. The present invention is not limited to this; the second frame 58 may be detachably attached by press fitting or with a lock mechanism.

(3) In the above-described illustrative aspect, the optical-type sensor is adopted as the "waste detecting unit". The sensor may be other non-optical type sensors (e.g. a noncontact-type sensor, a contact-type sensor, or the like).

(4) In the above-described illustrative aspect, the sending member 71 is provided as the "sending unit". The present invention is not limited to this. For example, the waste W may be sent by rotation of a rotatable member having an ellipsoidal cross-sectional shape and disposed in parallel to the cleaning roller 52 and the like. Or, it may simply be a bottom face of the waste-accommodating portion 72, which is downwardly inclined toward the rear end thereof. Or, the sending unit may be excluded. In this case, it is preferable that the second waste-accommodating portion 74 is upwardly raised by a step with respect to the first waste-accommodating portion 73.

(5) In the above-described illustrative aspect, the cleaning device 17 includes the cleaning mechanism such as the cleaning roller 52, the scraping roller 53, the blade 54, and the like as the "waste collecting device". The present invention is not limited to this; the cleaning mechanism, or parts thereof, may be excluded.

(6) In the above-described illustrative aspect, the collection opening 51 is elongated in the right-left direction, and the auger 80 is provided in parallel to the elongated direction of the collection opening 51. The present invention is not limited to this; the auger 80 maybe provided nonparallel to the direction. Note however that, in the case where the collection opening 51 is elongated in the right-left direction, the waste W can be accumulated into heaps at various zones along the elongated direction of the collection opening 51. Therefore, with the configuration of the above-described illustrative aspect, variation in detection results performed by the waste detecting unit due to the variation in the zones where the waste W is accumulated can be reduced.

Figure 13:
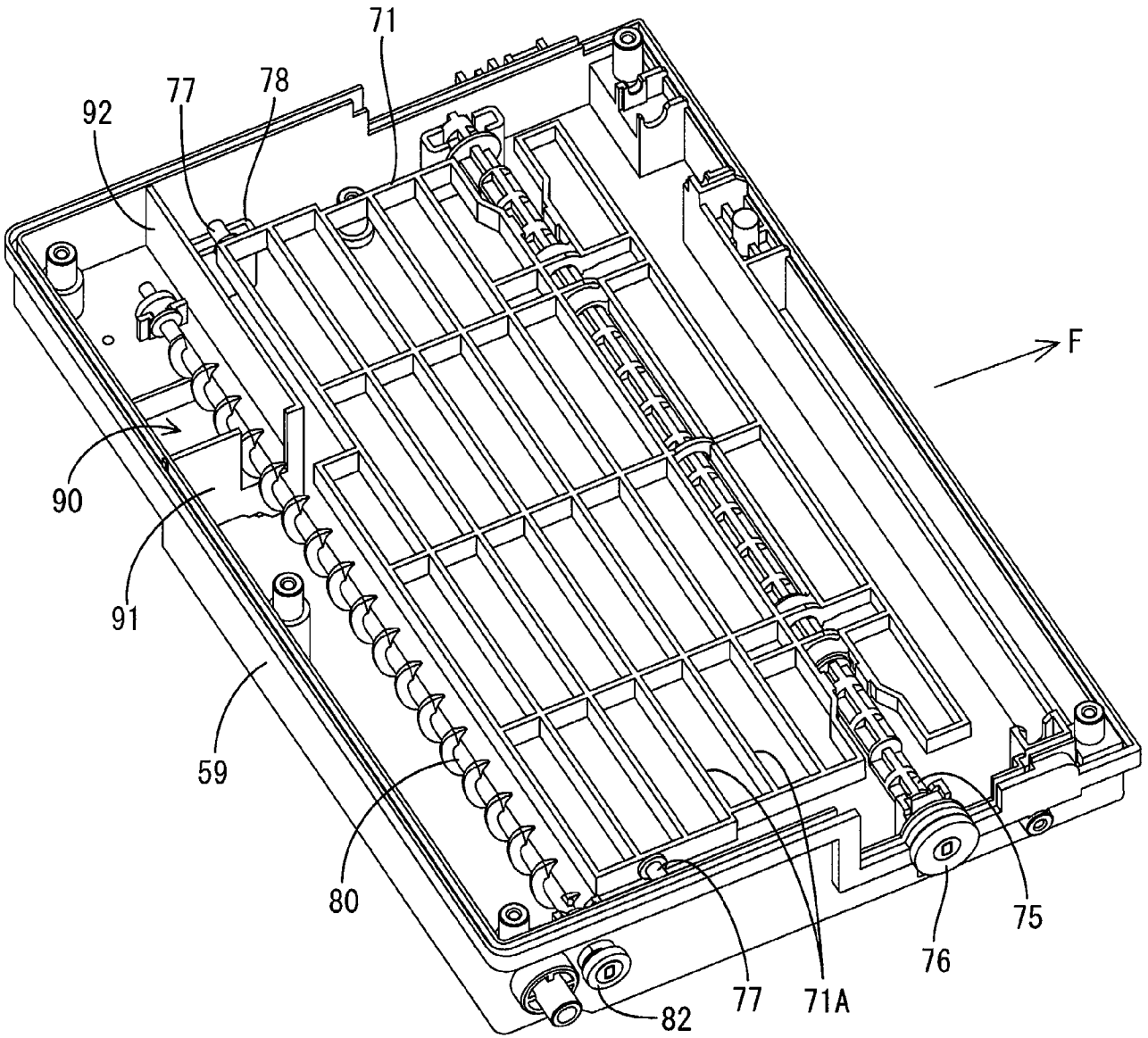
FIG. 13 is a perspective view showing an internal structure of the third frame of another illustrative aspect.

(7) In the above-described illustrative aspect, the auger 80 is disposed in a front side of the third frame 59 (in the second waste-accommodating portion 74). The auger 80 may be disposed in, for example, a rear side of the third frame 59 (in the first waste-accommodating portion 73) as shown in FIG. 13. In this case, a raised bottom portion 91, a guard wall 92, and a detection portion 90 should be disposed in the front-end side of the third frame 59. Note that they are configured similar to the above-described raised-bottom 83, the guard wall 84, and the detection portion 81. The auger 80 sends out the waste W gathered in the rear-end side of the third frame 59 by the sending member 71 into the detection portion 90. Even with such a configuration, the auger 80, regardless of difference in the zones where the large amount of waste W is accumulated, sends out the waste W accumulated in these zones in the direction of the rotational shaft. Thus, when the waste W is accumulated in the first waste-accommodating portion 73 to the predetermined height and substantially over the entire length of the auger 80, the waste W begins to enter the detection portion 90. Therefore, variation in the detection results due to the difference in the zones where the large amount of waste W is accumulated can be reduced. In a short, it is only necessary for the waste collecting device to include a collection opening, a waste-accommodating portion that receives the waste that has removed from a toner carrier and has entered from the collection opening, an auger that rotates about a predetermined rotational shaft in the waste-accommodating portion and thereby sends out the waste accommodated in the waste-accommodating portion in a sending direction along the rotational shaft, and a detection portion that is provided on the distal-end side of the sending direction by the auger, accommodates the waste sent moved by the auger, and renders the accommodated waste to the detection performed by a waste detecting unit.

(8) In the above-described illustrative aspect, the cleaning device 17 is detachable from, and attachable to, the body casing 2. The cleaning device 17 may be undetachable and attachable.

(9) In the above-described illustrative aspect, the printer 1 that exposes the photoreceptor using LEDs is illustrated. Other types of printers may be used, such as an electrophotographic image forming apparatus such as a laser printer that exposes the photoreceptor using laser light.

What is claimed is:

1. A waste collecting device comprising:

a first box including a top surface having a first opening, a bottom surface opposed to the top surface, and side surfaces connecting the top surface and the bottom surface and having a second opening, wherein the top surface, the bottom surface, and the side surfaces define a space allowing waste to be accommodated therein;

a second box including a top surface, a bottom surface opposed to the top surface, and side surfaces connecting the top surface and the bottom surface and having a third opening, the third opening being in communication with the second opening; and a sending unit disposed in the first box and disposed outside the second box, the sending unit configured to send the waste in a direction away from the second box.

2. The waste collecting device according to claim 1, wherein the sending unit includes:

a sending member, the sending member having a first end portion located near the second box, a second end portion located away from the second box, and a crankshaft configured to rotate relative to the first end portion and cause the first end portion to move back and forth and up and down and thereby reciprocate the second end portion in directions toward and away from the second box.

3. The waste collecting device according to claim 1, wherein the second box includes an auger and a detection portion, the auger having a distal end portion and a rotational shaft, the detection portion disposed below the distal end portion of the auger, wherein the auger is configured to rotate about the rotational shaft such that the waste accommodated in the second box is moved toward the detection portion along the rotational shaft, and wherein the detection portion accommodates the waste moved by the auger.

4. The waste collecting device according to claim 3, wherein:

the first opening is defined by an elongated edge; and the auger is disposed in parallel to the elongated edge of the first opening.

5. The waste collecting device according to claim 3, further comprising a guard wall, wherein the guard wall prevents the waste in the first box from entering the detection portion in a direction perpendicular to the auger.

6. The waste collecting device according to claim 1, further comprising:

a handle, wherein the side surfaces of the first box include first side surface having the second opening, and wherein the side surfaces of the second box include a side surface to which the handle is attached.

7. An image forming apparatus comprising:

a toner carrier;

a waste collecting device including:

a first box including a top surface having a first opening, a bottom surface opposed to the top surface, and side surfaces connecting the top surface and the bottom surface and having a second opening, wherein the top surface, the bottom surface, and the side surfaces define a space allowing waste to be accommodated therein;

a second box including a top surface, a bottom surface opposed to the top surface, and side surfaces connecting the top surface and the bottom surface and having a third opening, the third opening being in communication with the second opening; and a sending unit disposed in the first box and disposed outside the second box, the sending unit configured to send the waste in a direction away from the second box;

a waste detecting unit configured to detect the waste in the second box of the waste collecting device; and a determination unit configured to determine on a basis of a result detected by the waste detecting unit whether an amount of the waste accommodated in the waste collecting device has reached a predetermined amount.

8. A waste collecting device comprising:

a main body;

a first space formed in the main body and communicating to the outside of the main body for allowing a waste to be collected in the first space;

a second space formed in the main body and communicating with the first space; and a sending unit disposed in the first space and disposed outside the second space, the sending unit configured to send the waste in a direction away from the second space, the sending unit including a rectangular plate with a plurality of holes.

9. The waste collecting device according to claim 8, wherein the sending unit includes a sending member, the sending member having a first end portion located near the second space, a second end portion located away from the second space, and a crankshaft, and wherein the crankshaft is configured to rotate relative to the first end portion and thereby reciprocate the second end portion in directions toward and away from the second space.

10. The waste collecting device according to claim 8, wherein the second space includes an auger and a detection portion, the auger having a distal end portion and a rotational shaft, the detection portion disposed below the distal end portion of the auger, wherein the auger is configured to rotate about the rotational shaft such that the waste accommodated in the second space is moved toward the detection portion along the rotational shaft, and wherein the detection portion accommodates the waste moved by the auger.

11. The waste collecting device according to claim 10, further comprising a guard wall, wherein the guard wall prevents the waste in the first space from entering the detection portion in a direction perpendicular to the auger.

12. The waste collecting device according to claim 8, further comprising a handle disposed on an outside surface of the main body;

wherein the outside surface is nearer to the second space than the first space.

13. A waste collecting device comprising:

a body frame including a first side and a second side, the second side spaced from the first side;

a sending member located within the body frame and spaced from the first side;

a detection portion located within the body frame such that the detection portion is spaced from the sending member and the second side, the detection portion located near the first side; and a handle attached to the body frame, wherein the handle is attached to the first side of the body frame.

14. The waste collecting device according to claim 13, further comprising:

a cleaning unit disposed at a first opening of the body frame, the cleaning unit including:

a cleaning roller configured to collect the waste;

a scraping roller configured to scrape off the waste from the surface of the cleaning roller onto the surface of the removing roller; and a blade configured to scratch off the waste from the removing roller.

15. A waste collecting device comprising:

a first box including:

a top surface having a first opening, a bottom surface opposed to the top surface, and side surfaces connecting the top surface and the bottom surface, such that the top surface, the bottom surface, and the side surfaces define a space allowing waste to be accommodated therein, the first box further including a second opening and an area adjacent to the second opening;

a second box including:

a top surface, a bottom surface opposed to the top surface, and side surfaces connecting the top surface and the bottom surface, the second box further including a third opening, the third opening being in communication with the second opening; and a sending unit disposed in the first box and configured to send the waste in a direction away from the second box, wherein the sending unit is configured to send the waste located in the area away from the second opening.

* * * * *